US007817935B2

(12) United States Patent
Izawa et al.

(10) Patent No.: US 7,817,935 B2
(45) Date of Patent: Oct. 19, 2010

(54) ELECTROPHOTOGRAPHIC PRINTER

(75) Inventors: Hideo Izawa, Narashino (JP); Junichi Setoyama, Narashino (JP); Kouichi Ooyama, Yokote (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 13 days.

(21) Appl. No.: 12/343,815

(22) Filed: Dec. 24, 2008

(65) Prior Publication Data

US 2009/0169254 A1 Jul. 2, 2009

(30) Foreign Application Priority Data

Dec. 27, 2007 (JP) ..... 2007-336381

(51) Int. Cl.
*G03G 15/00* (2006.01)

(52) U.S. Cl. ..... 399/110; 399/107; 399/116; 399/117

(58) Field of Classification Search ..... 399/107, 399/110, 116, 117
See application file for complete search history.

(56) References Cited

U.S. PATENT DOCUMENTS

| | | | | |
|---|---|---|---|---|
| 5,742,319 | A | 4/1998 | Fukunaga et al. | |
| 5,960,714 | A | 10/1999 | Gotting | |
| 6,240,267 | B1 * | 5/2001 | Compera | 399/117 |
| 6,259,873 | B1 * | 7/2001 | Shifley et al. | 399/110 |

(Continued)

FOREIGN PATENT DOCUMENTS

| | | |
|---|---|---|
| EP | 0677795 A2 | 10/1995 |

(Continued)

OTHER PUBLICATIONS

European Search Report dated Jul. 17, 2009, issued in corresponding European Patent Application No. 08163279.6.

*Primary Examiner*—David P Porta
*Assistant Examiner*—Casey Bryant
(74) *Attorney, Agent, or Firm*—Westerman, Hattori, Daniels & Adrian, LLP

(57) ABSTRACT

An electrophotographic printer in which a photoconductor drum and a transfer drum can be supported in a simple component construction and in the makeup free from misalignment and development of thrust load. To this end, an electrophotographic printer comprising a photoconductor drum (1) and a transfer drum (2) is provided in which each of the photoconductor and transfer drums is fitted on a drum body (12, 13) so as to be extractable therefrom towards a front side, the shaft at a back side of the drum body being supported in a cantilever fashion by a bearing unit (16) supported on a main frame ($F_1$) at the back side; the shaft at the front side of the drum body is supported by a movable bearing (17, 18) which comprises a shaft holding cylinder (24) axially extractable from the shaft and a housing (22, 23) supporting the shaft holding cylinder via a bearing (30); two such movable shafts are supported on a swingable frame (21) mounted so as to be swingable on a main frame ($F_2$) at the front side; and the housing (23) of the movable bearing for the transfer drum and the housing (31) of the bearing unit supporting the shaft at the back side of the drum body for the transfer drum are housings decentered from the transfer drum so that angularly displacing the housings makes the transfer drum movable towards and away from the photoconductor drum.

2 Claims, 6 Drawing Sheets

U.S. PATENT DOCUMENTS

| | | | | |
|---|---|---|---|---|
| 6,327,975 | B1 * | 12/2001 | Izawa | 101/170 |
| 6,427,059 | B1 * | 7/2002 | Buch et al. | 399/110 |
| 2005/0254854 | A1 | 11/2005 | Deguchi | |
| 2009/0169271 | A1 * | 7/2009 | Izawa et al. | 399/279 |

FOREIGN PATENT DOCUMENTS

| | | | |
|---|---|---|---|
| EP | 1048462 | A1 | 11/2000 |
| GB | 2329151 | A | 3/1999 |
| JP | 3037279 | B2 | 4/2000 |
| JP | 2006-30643 | A | 2/2006 |
| JP | 2006-251524 | A | 9/2006 |
| JP | 2007-206187 | A | 8/2007 |

* cited by examiner

ELECTROPHOTOGRAPHIC PRINTER

TECHNICAL FIELD

The present invention relates to an electrophotographic printer having a photoconductor drum and a transfer drum.

BACKGROUND ART

In an electrophotographic printer of this type, it is desirable that the photoconductor and transfer drums for maintenance and inspection should easily be detachable. And, as the prior art which allows such easy detachment there is known a drum apparatus disclosed in JP Patent No. 3037279, though it is a little different in the field of art concerned.

The drum apparatus of this prior art relates to a rotary press equipped with at least one drum whose journals are borne by a pair of side walls. One of these side walls has a door or removable cover swingably supported on the side wall, and the drum is supported by the door or cover via a bearing so that swinging the door or cover open opens an end face side of the drum.

And, the end face side of the drum facing the door is provided with a separable area which comprises conically shaped portions in a pair having a truncated conical projection and a truncated conical recess fitted with the projection. In the separable area, a journal or a portion of the journal can be separated from the body of the drum and can be swung by the door together with the bearing.

In this prior art, the bearing and the drum may be coupled together by the recessed and projecting conical portions and their axial centers may be positioned by the conical portions.

In the prior art mentioned above, the conical portions are hard to machine with precision and the center positions of their recessed and projecting shapes are easily misaligned. The conical recess and projection when connected together tend to produce a partial contact, and there arises, e. g., the problem that the wear of a portion of the partial contact goes on quickly. Besides, depending on an angular makeup of the conical shapes a thrust load develops as a component of force of a radial load with respect to an axis. As a result, the problem arises that a run-out may be created of the axial center unless all the components in a direction of thrust are fixed in the thrust direction.

It is an object of the present invention to provide an electrophotographic printer in which a photoconductor and a transfer drum can be supported in a simple component construction and in the makeup free from misalignment and development of thrust load.

DISCLOSURE OF THE INVENTION

In order to achieve the object mentioned above, there is provided an electrophotographic printer comprising a photoconductor drum and a transfer drum, characterized in that each of the photoconductor and transfer drums is fitted on a drum body so as to be extractable therefrom towards a front side, the shaft at a back side of the drum body being supported in a cantilever fashion by a bearing unit supported on a main frame at the back side; the shaft at the front side of the drum body is supported by a movable bearing which comprises a shaft holding cylinder axially extractable from the shaft and a housing supporting the shaft holding cylinder via a bearing; two such movable bearings are supported on a swingable frame mounted so as to be swingable on a main frame at the front side; and the housing of the movable bearing for the transfer drum and the housing of the bearing unit supporting the shaft at the back side of the drum body for the transfer drum are housings decentered from the transfer drum so that angularly displacing the housings makes the transfer drum movable towards and away from the photoconductor drum.

And, the swingable frame may be divided separately into a part supporting the movable bearing for the photoconductor drum and a part supporting the movable bearing for the transfer drum so that the two parts can be swung individually.

According to the present invention, a photoconductor and a transfer drum rendered easily detachable can be retained with a bearing of an ordinarily used radial structure on which a component of force other than in the direction orthogonal to the shaft such as a component of force in the thrust direction when they are rotating can no longer act, so that their axial center run-out by rotation can be limited to the minimum, thereby permitting the printing accuracy as well as the printing quality to be maintained.

Also, the bearing structure for supporting the shaft at the front side of the drum body on which the corresponding photoconductor or transfer drum is fitted and supported is simple. Moreover, the detachment of each of the photoconductor and transfer drums from the corresponding shaft can easily be effected simply by retracting the shaft holding cylinder and then swinging the swingable frame, thus permitting them to be detached easily for maintenance and inspection.

Further, by dividing the swingable frame for supporting the movable bearings at the respective front sides of the photoconductor and transfer drums into parts separate for each of the movable bearings to swing the parts separate of each other, it is possible to perform the maintenance and inspection individually separately for each of the photoconductor and transfer drums, in accordance with their individual durability.

BEST MODES FOR CARRYING OUT THE INVENTION

Figure 1:
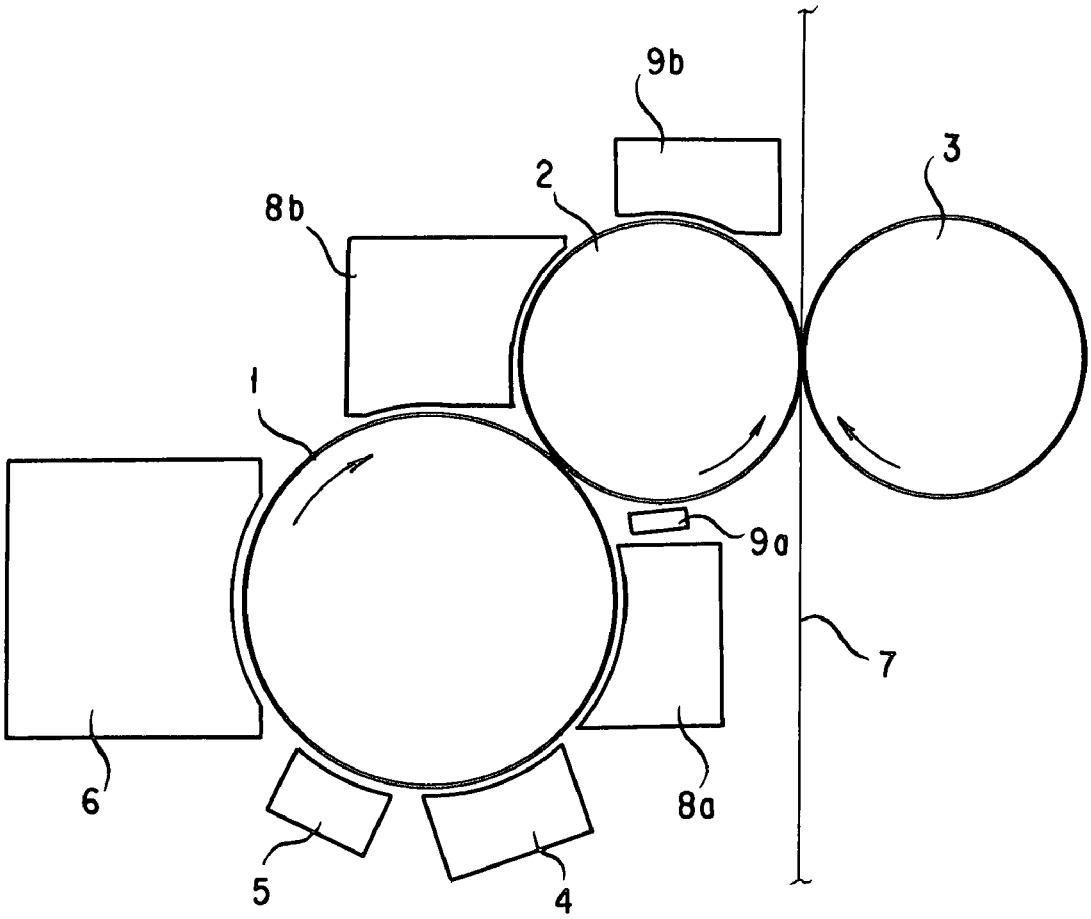
FIG. 1 is a constructive explanatory view illustrating an electrophotographic printer according to a form of implementation of the present invention.

FIG. 1 is an explanatory view diagrammatically illustrating an electrophotographic printer for which the present invention is carried out. In the Figure, there are shown a photoconductor drum 1, a transfer drum 2 juxtaposed in contact with the photoconductor drum 1 and a backup roller 3 juxtaposed in contact with the transfer drum 2.

In this electrophotographic printer, the photoconductor drum 1 is driven by a drive means such as a motor (not shown) to rotate at a constant speed in the direction of arrow when images are to be formed. The surface of the photoconductor drum 1 is evenly charged in the dark by a charging unit 4 and then irradiated by an exposure unit 5 to form a light image of an original, i. e., an electrostatic latent image thereof. Thereafter, the electrostatic latent image when passing through a developing area is made visual by a developing unit 6 to form a toner image on the surface of the photoconductor drum 1.

And, the toner image on the surface of the photoconductor drum 1 is primarily transferred in a transfer area onto the surface of the transfer drum 2 under a bias voltage applied through the transfer drum 2 and a nip pressure between the drums and the primarily transferred toner image is transferred in a secondary transfer area secondarily onto a recording medium 7 passing between the transfer drum 2 and the backup roller 3. Shown also in the Figure are a photoconductor clearer 8*a* for removing residual tonner on the photoconductor drum 1, a transfer-drum cleaner 8*b* for removing residual toner on the transfer drum 2, a static eliminator 9*a* and a career liquid supply unit.

Figure 2:
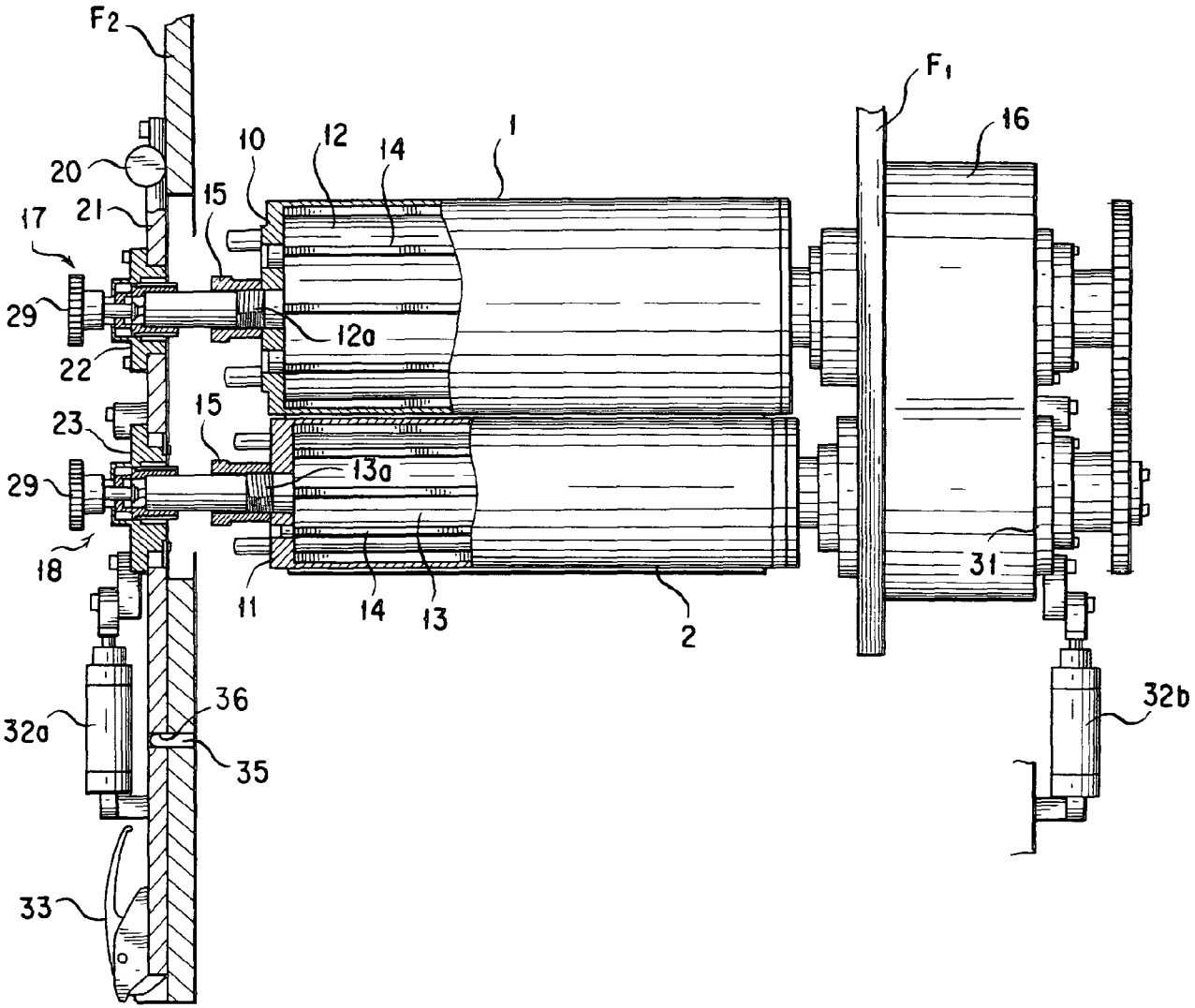
FIG. 2 is a partially cutaway cross sectional view illustrating the electrophotographic printer shown in FIG. 1.
Figure 6:
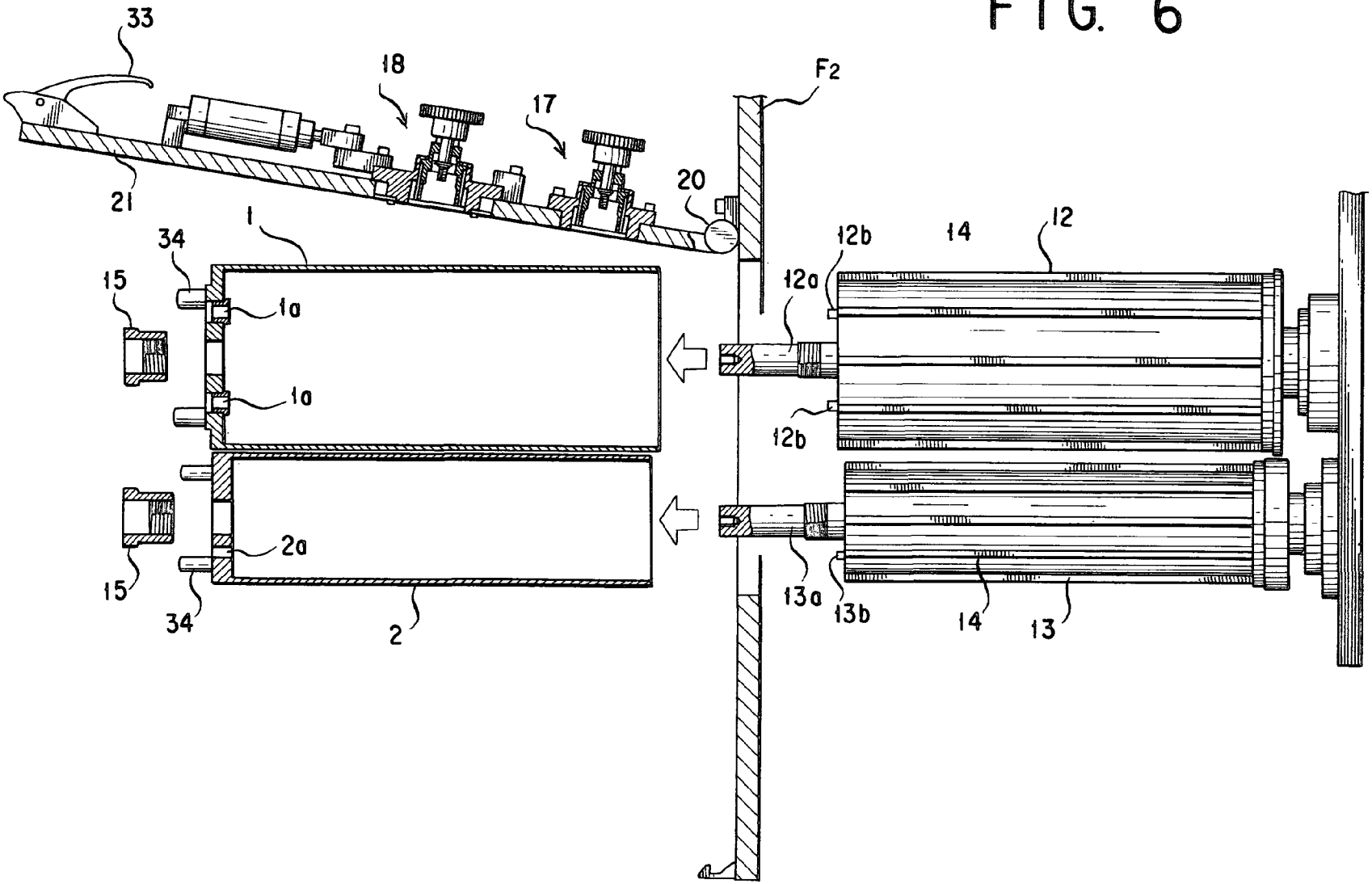
FIG. 6 is an exploded view illustrating a disengaging operation for a photoconductor drum and a transfer drum in the electrophotographic printer shown in FIGS. 1 and 2.

The photoconductor drum 1 and the transfer drum 2 are constructed as shown in FIG. 2. The photoconductor and transfer drums 1 and 2 are each in the form of a sleeve closed at its front side (as shown in FIG. 2, its left hand side) with an end plate 10, 11 which is removably fitted with the drum body 12, 13 from the front side. Each drum body 12, 13 is provided over its periphery with a plurality of guide members 14 parallel to the axial direction with which the inner periphery of each drum 1, 2 is guided. And, each drum 12, 13 is clamped backwards (rightwards as shown in FIG. 2) with a clamping screw 15, 15 screwed with a screw formed on a shaft 12*a*, 13*a* at its front side. The drum body 12, 13 then is circumferentially positioned as shown in FIG. 6 with projections 12*b* and 13*b* by fitting them in holes 1*a* and 2*a* formed in the end plates 10 and 11 of the photoconductor and transfer drums 1 and 2, respectively.

The respective shafts of the drum bodies 12 and 13 at their backward side are supported in a cantilever fashion by a bearing unit 16 supported on a main frame $F_1$ of the electrophotographic printer at its backward side. Also, the shafts 12*a* and 13*a* at their respective front sides are supported by movable bearings 17 and 18, respectively, each of which is made movable axially. Each of these movable bearings 17 and 18 is mounted on a swingable frame 21 whose one end is pivotably mounted via a hinge member 20 on a main frame $F_2$ of the electrophotographic printer at its front side Inasmuch as the movable bearings 17 and 18 are of the same makeup except that they differ in makeup only of housings 22 and 23 which are mounted on the swingable frame 21 which supports these movable bearings, an explanation is given solely of the movable bearing 17 with reference to FIG. 3.

A shaft holding cylinder 24 fits on the shaft 21*a* tightly and slidably from a front end over a fitting depth size L and has its outer periphery made up of a bearing journal 25. And, in the shaft holding cylinder 24, a stop shaft 27 passing through its axial center from its front and having a male thread 26 at an end is rotatably supported so as to be oriented axially thereof via a thrust bearing 28. The stop shaft 27 has a knob 29 fastened thereto at the side opposite to that end. The male screw 26 is screwed with a female thread 12*c* formed in the end of the shaft 12*a* at the front side of the drum body 12.

The bearing journal 25 on the shaft holding cylinder 24 is supported by the housing 22 fastened to the swingable frame 21, so as to be both rotatable and axially slidable via a bearing 30 using, e. g., a needle bearing. And, the shaft holding cylinder 24 is adapted to be movable to the front side with respect to the housing 22 over a range longer than the depth size L of fitting between the shaft 12*a* and the shaft holding cylinder 24.

Figure 3:
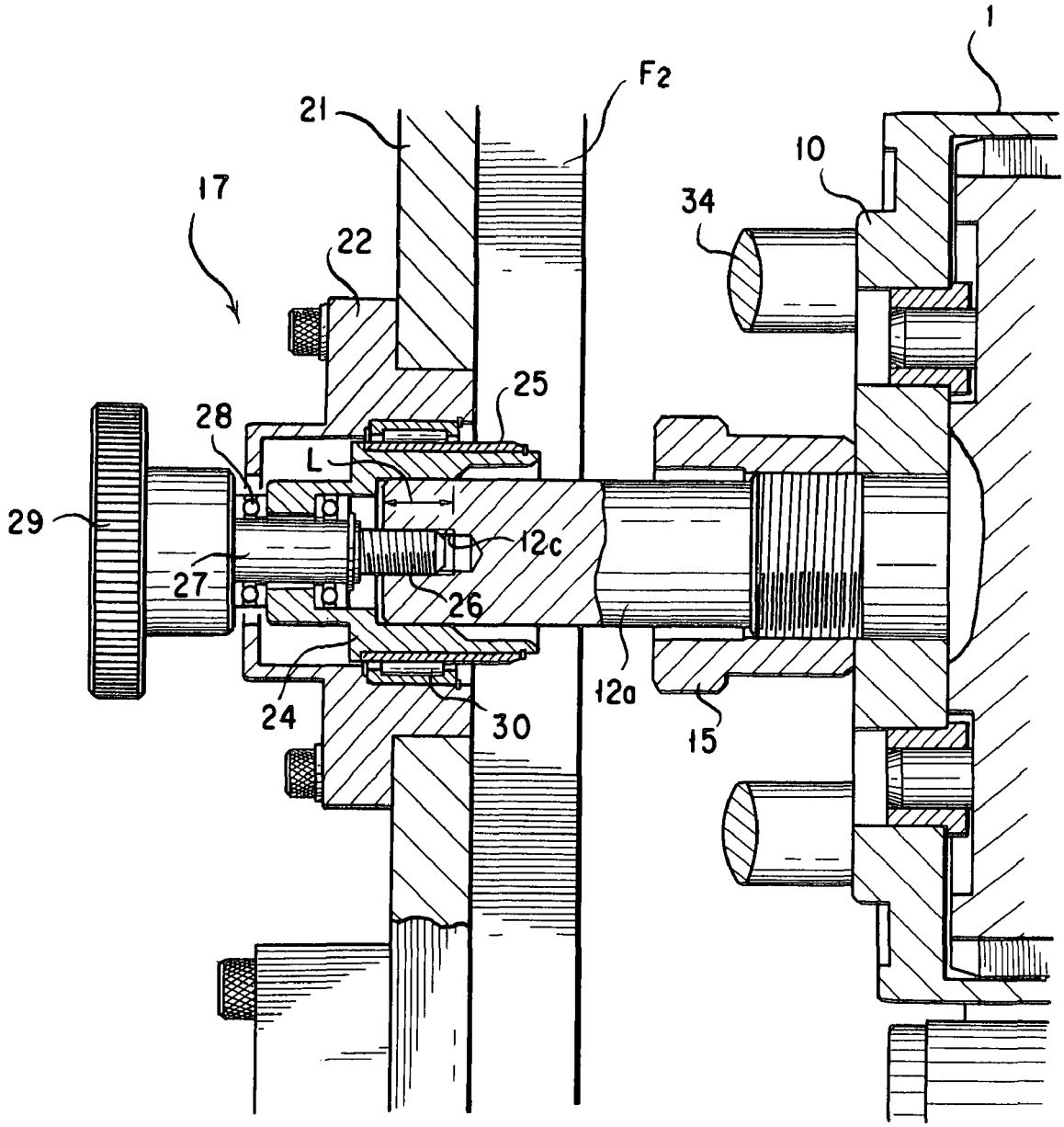
FIG. 3 is a cross sectional view illustrating an essential part of the electrophotographic printer of FIGS. 1 and 2 in the state that a movable bearing has been engaged.

FIG. 3 shows the state that as the stop shaft 27 is rotated with the knob 29 the male thread 26 formed at its end is threaded into the female thread 12*c* of the shaft 12*a*. In this state, the shaft holding cylinder 24 with the stop shaft 27 has been moved forwards following the threading movement of the stop shaft 27 with its cylindrical part fitted on the shaft 12*a* over the fitting depth L. And, in this state, by clamping action of the stop shaft 27 the shaft holding cylinder 24 is united with the shaft 12*a* so that the shaft 12*a* is supported by the housing 22 via this shaft holding cylinder 24 and a bearing 30.

Figure 4:
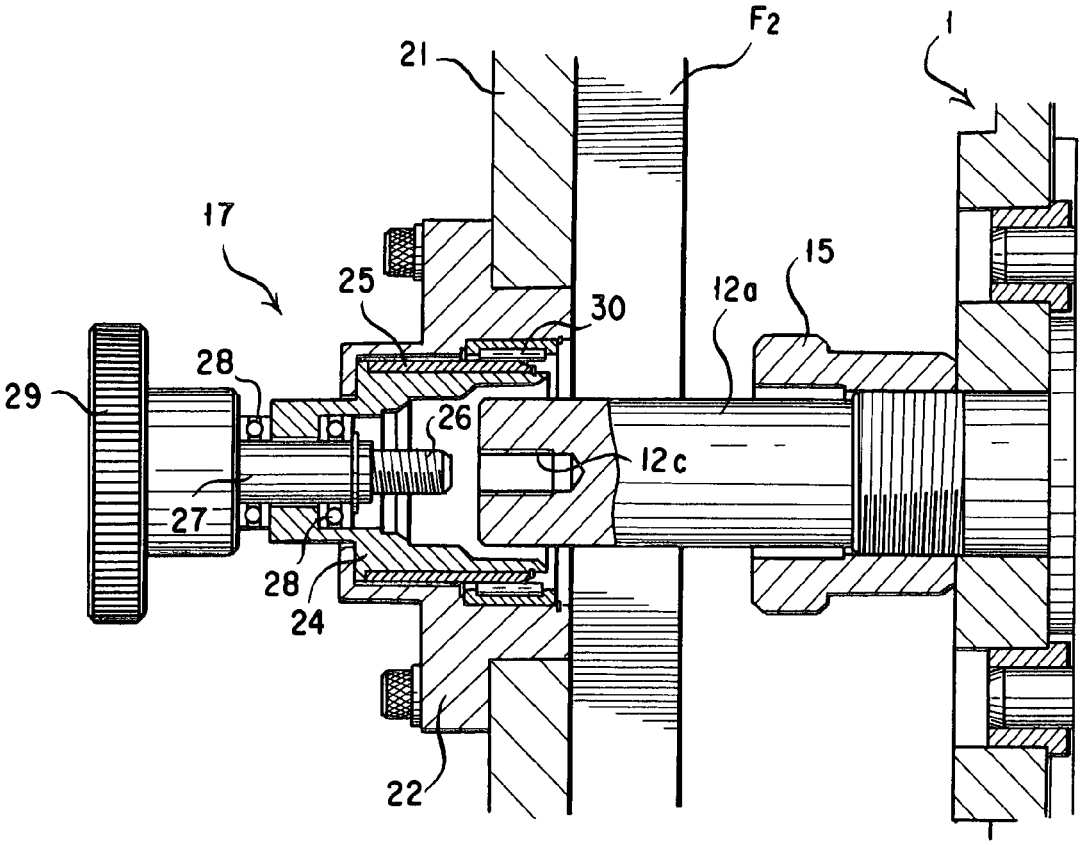
FIG. 4 is a cross sectional view illustrating an essential part of the electrophotographic printer of FIGS. 1 and 2 in the state that a movable bearing has been disengaged.

FIG. 4 shows the state that as the stop shaft 27 is reversely rotated with the knob 29 the male thread 26 formed at its end is threaded out of and disengaged from the female thread 12*c*. In this state, the shaft holding cylinder 24 has been moved backwards following the stop shaft 27 getting out and moreover with the stop shaft 27 freely moved backwards following the male thread 26 disengaged from the female thread 12*a* and, then with the cylindrical part of the shaft holding cylinder 24 getting out of the shaft 12*a* the shaft 12*a* is set free from the movable bearing 17 both axially and perpendicularly thereto.

Figure 5:
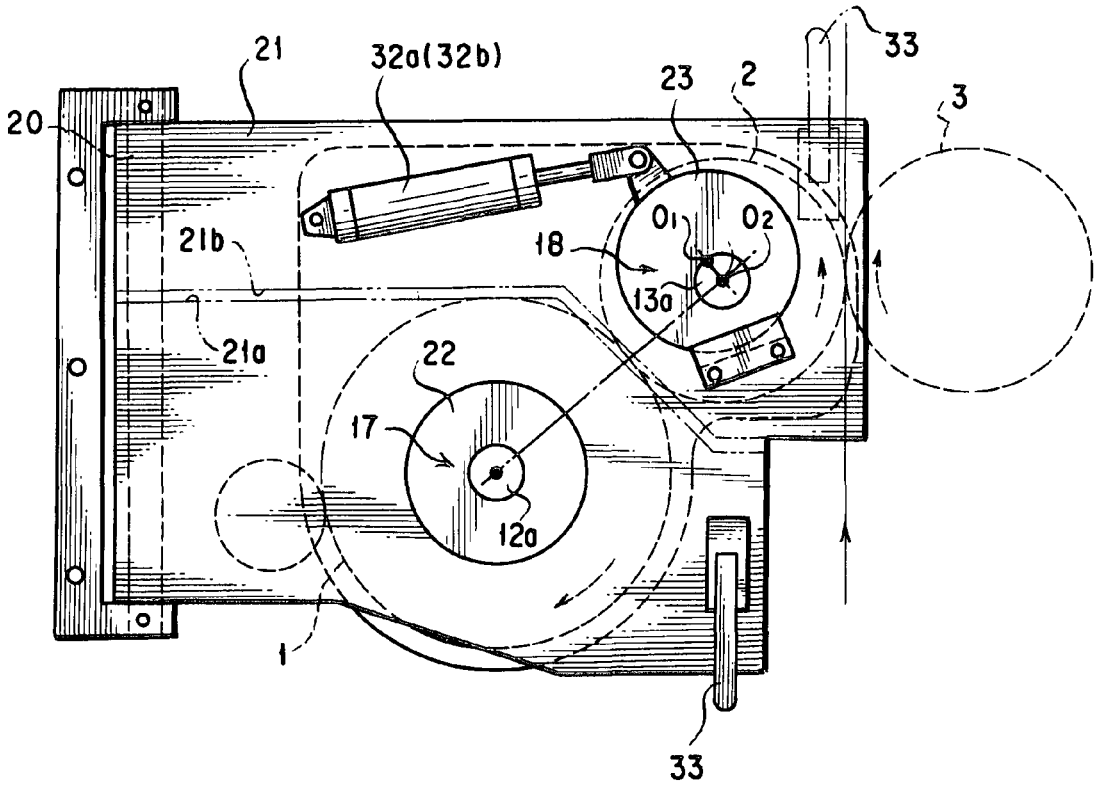
FIG. 5 is a front view illustrating a swingable frame in the electrophotographic printer shown in FIGS. 1 and 2.

While the other movable bearing 18 supporting the shaft 13*a* at its front side of the drum body 13 of the transfer drum 2 shown in FIG. 2 is identical in makeup to the movable bearing 17 for the photoconductor drum 1, the housing 23 receiving its bearing 30 at the front side is rotatably supported on the swingable frame 21. And, as shown in FIG. 5 the center $O_2$ of the bearing 30 as the center of the shaft 13*a* of the drum body 13 is decentered from the center of rotation $O_1$ of the housing 23 with respect to the swingable frame 21.

Also, in the bearing unit 16 shown in FIG. 2, a housing 31 supporting at the back side the shaft of the drum body 13 of the transfer drum 2 is made symmetrical in structure with, and identical in decentering construction to, the housing 23 at the front side.

And, one ends of cylinder units 32*a* and 32*b* operated under liquid or air pressure are coupled to the two housings 23 and 31, respectively, so that operating the two cylinder units 32*a* and 32*b* synchronously turns the two housings 23 and 31 in an identical direction and allows the axis of the transfer drum 2 supported by the housings 23 and 31 as decentered to move towards and away from the photoconductor drum 1. The other end of the cylinder unit 32*a* at the front side is coupled to the swingable frame 21 and the other end of the cylinder unit 32*b* at the back side is coupled to the frame $F_1$.

The swingable frame 21 is provided at its end with a clamp handle 33 for clamping the swingable frame 21 to the frame $F_2$ when the swingable frame 21 is brought in the state that it lies on the frame $F_2$ at the front side, namely in a closed state. Also, in this clamping state a positioning pin 35 formed on the frame $F_2$ fits in a hole 36 formed in the swingable frame 21 for its positioning.

In the makeup mentioned above, mention is made of a procedure for disengaging the photoconductor drum 1 and the transfer drum 2 from the electrophotographic printer.

Referring to FIGS. 2 and 5, the cylinder unit 32*a* at the front side and the cylinder unit 32*b* at the back side are synchronously, e. g., contracted in FIG. 5 to rotate the housings 23 and 31 so that the axis of the transfer drum 2 is moved away from the axis of the photoconductor drum 1. This holds the confronting peripheral surfaces of the photoconductor drum 1 and the transfer drum 2 away from each other.

Next, the respective knobs 29 for the two movable bearings 17 and 18 are rotated in the direction in which the male threads 26 get out to disengage the male threads 26 from the female threads 12*b* and 13*b* in the shafts 12*a* and 13*b* of the drum bodies 12 and 13, thereby drawing the cylindrical parts of the shaft holding cylinders 24 from the shafts 12*a* and 13*a*, respectively. FIG. 4 shows this state whereby each of the shafts 12*a* and 13*a* becomes free radially from the shaft holding cylinder 24, 24 of the movable bearing 17, 18. In this state, both the drums 12 and 13 are supported in a cantilever fashion by the bearing unit 16 at the back side.

Subsequently, the clamp handle 33 is acted on to unclamp the swingable frame 21 from the frame $F_1$ at the front side and swing the swingable frame 21 open. The swingable frame 21 can then be swung open on the hinge member 20 as a support point without interfering with the shafts 12*a* and 13*a* since the shafts 12*a* and 13*a* for the drum bodies 12 and 13 are then free radially from the respective shaft holding cylinders 24 and 24 of the movable bearings 17 and 18.

Next, as shown in FIG. 6, the clamping screws 15 and 15 screwed with the shafts 12*a* and 13*a* of the drum bodies 12 and 13 re spectively for the photoconductor and transfer drums 1 and 2 are each removed, and the drums 1 and 2 are extracted from the drum bodies 12 and 13, respectively, to take them outside of the main frame F2 at the front side. This operation is done with handgrips 34 mounted on the end plates 10 and 11 for the drums 1 and 2.

On the other hand, a new photoconductor drum 1 and a new transfer drum 2 may be fitted onto the drum bodies 12 and 13 by a procedure reverse to the disengagement procedure mentioned above. And, in this fitting state the drums 1 and 2 are fastened to the drum bodies 12 and 13 with the clamping screws 15 and 15, respectively. Then, the shafts 12*a* and 13*a* at the front side of the drum bodies 12 and 13 are supported by the bearings 30 and 30 via the shaft holding cylinders 24 of the movable bearings 17 and 18, respectively, and each of the drum bodies 12 and 13 is held at both sides. The shaft holding cylinders 24, 24 of the movable bearings 17, 18 are rotated together with the drum body 12, 13 and the knob 29, 29, respectively. Also, when the photoconductor and transfer drums 1 and 2 are engaged with and disengaged from the drum bodies 12 and 13, the inner peripheral surfaces of the drums 1 and 2 are guided, respectively, by the guide members 14 provided circumferentially on the drum bodies 12 and 13, respectively. Then, with the guide members 14 formed of a resinous material both slidable and soft, the drums 1 and 2 are prevented from getting hurt on their insides.

While in the form of implementation described above it is shown that the movable bearings 17 and 18 retaining the shafts 12*a* and 13*a* at the front side of the drum bodies 12 and 13 for the photoconductor and transfer drums 1 and 2 are mounted on a single swingable frame 21 to cause the swingable frame 21 to be swung so that the movable bearings 17 and 18 are movable together, the wing frame 21 as indicated by the chain line in FIG. 5 may be divided separately into a swingable frame 21*a* supporting the movable bearing 17 for the photoconductor drum 1 and a swingable frame 21*b* for supporting the movable bearing 18 for the transfer drum 2 so that the two swingable frames can detachably be clamped individually to the frame F2 at the front side by means of clamp handles 33 and 33, respectively.

In this case, the photoconductor drum 1 and the transfer drum can individually be clamped and detached, permitting both the drums 1 and 2 different in rate of wear to be maintained and inspected correspondingly and each independently of the other.

What is claimed is:

1. An electrophotographic printer comprising a photoconductor drum and a transfer drum, characterized in that:

wherein the photoconductor drum includes a first drum body having a front side and a back side opposite to the front side, wherein the photoconductor drum is fitted on the first drum body so as to be extractable therefrom toward the front side of the first drum body, wherein the first drum body includes a first front shaft at the front side thereof and a first back shaft at the back side thereof, the first back shaft of the first drum body being supported in a cantilever fashion by a first bearing unit supported on a first main frame at the back side of the first drum body, wherein the transfer drum includes a second drum body having a front side and a back side opposite to the front side, wherein the transfer drum is fitted on the second drum body so as to be extractable therefrom toward the front side of the second drum body, wherein the second drum body includes a second front shaft at the front side thereof and a second back shaft at the back side thereof, the second back shaft of the second drum body being supported in a cantilever fashion by a second bearing unit supported on the first main frame, wherein the first front shaft of said first drum body is supported by a first movable bearing comprising a first shaft holding cylinder axially extractable from said first front shaft and a first housing supporting said first shaft holding cylinder via a first bearing, wherein the second front shaft of said second drum body is supported by a second movable bearing comprising a second shaft holding cylinder axially extractable from said second front shaft and a second housing supporting said second shaft holding cylinder via a second bearing, wherein the first and second movable bearings are supported on a swingable frame mounted so as to be swingable on a second main frame at the front side; and wherein the second bearing unit for the transfer drum comprises a third housing, wherein the second housing for the transfer drum and the third housing for the transfer drum are housings decentered from the transfer drum so that angularly displacing the second and third housings makes the transfer drum movable towards and away from the photoconductor drum.

2. An electrophotographic printer as set forth in claim 1, characterized in that the swingable frame is divided separately into a first part supporting the first movable bearing for the photoconductor drum and a second part supporting the second movable bearing for the transfer drum so that the first and second parts can be swung individually.

* * * * *